United States Patent [19]

Baset

[11] 4,332,675

[45] Jun. 1, 1982

[54] REMOVAL OF BASIC NITROGEN COMPOUNDS FROM ORGANIC STREAMS

[75] Inventor: Zeinab Baset, New Providence, N.J.

[73] Assignee: Exxon Research & Engineering Co., Florham Park, N.J.

[21] Appl. No.: 218,022

[22] Filed: Dec. 19, 1980

[51] Int. Cl.[3] ..... C10G 21/10

[52] U.S. Cl. ..... 208/254 R; 208/293

[58] Field of Search ..... 208/254 R, 293

[56] References Cited

U.S. PATENT DOCUMENTS

| | | | |
|---|---|---|---|
| 1,947,868 | 2/1934 | Morrell et al. | 208/293 |
| 2,079,782 | 5/1937 | Wells | 208/293 |
| 2,410,042 | 10/1946 | Bond | 208/293 |
| 2,754,248 | 7/1956 | Wetzel | 208/254 R |

FOREIGN PATENT DOCUMENTS

| | | | |
|---|---|---|---|
| 369785 | 3/1932 | United Kingdom | 208/254 R |

OTHER PUBLICATIONS

Voroshzov et al., "Ber. (Abstract)," 63B, pp. 2354–2362 (1930).

DeCarli, "Gass. Chim. Ital. (Abstract)," 57, pp. 347–355 (1927).

Zhurin et al., "Zh. Obshch. Khim. (Abstract)," 33(10), pp. 3360–3364 (1963).

Sharada et al., "Current Sci., India (Abstract)," 29, pp. 130–131 (1960).

Hata et al., "Nature (Abstract)," 203 (4952), pp. 1378–1379 (1964).

*Primary Examiner*—John Doll

*Attorney, Agent, or Firm*—Henry E. Naylor

[57] ABSTRACT

Basic nitrogen compounds are removed from organic streams which are substantially free of water by contacting the stream with gaseous sulfur dioxide thereby precipitating a complex containing the basic nitrogen compounds and sulfur dioxide, and thereafter separating the precipitating complex from the contacted stream. The basic nitrogen compounds and the sulfur dioxide can then be regenerated from the complex.

6 Claims, No Drawings

REMOVAL OF BASIC NITROGEN COMPOUNDS FROM ORGANIC STREAMS

BACKGROUND OF THE INVENTION

The present invention relates to a method for separating basic nitrogen compounds from organic streams by the use of gaseous sulfur dioxide, wherein such streams are substantially free of water.

It is generally considered undesirable to have basic nitrogen compounds present in various organic streams, particularly hydrocarbonaceous streams such as coal liquids, oil shale liquids and petroleum oils. These basic nitrogen compounds, even if present in very small quantities, have been attributed to creating aging problems in coal and oil shale liquids, acting as poisons or deactivants for catalysts in the cracking of crude oil, and being detrimental in oils used as lubricants, fuel oils, medicinal oils, etc.

Although various methods have been employed for separating basic nitrogen compounds from such organic liquids, there is still a need in the art for a more efficient separation method.

SUMMARY OF THE INVENTION

In accordance with the present invention there is provided a method for separating basic nitrogen compounds from an organic stream, which is substantially free of water, which method comprises (a) contacting the stream with gaseous sulfur dioxide, thereby forming and precipitating a complex comprising the basic nitrogen compound and sulfur dioxide, and (b) separating the precipitated complex from the treated stream.

In another preferred embodiment of the present invention the precipitated complex which has been separated from the stream, is heated, thereby regenerating both the basic nitrogen compounds and sulfur dioxide. The sulfur dioxide can then be recycled for contacting the feed stream.

DETAILED DESCRIPTION OF THE INVENTION

Various types of basic nitrogen compound-containing organic streams are suitable for the practice of the present invention. Particularly suitable are those organic streams such as the hydrocarbonaceous streams selected from the group consisting of coal liquids, oilshale liquids, and petroleum oils. Also, coal bottoms, or heavy coal fractions soluble in common organic solvents at the reaction temperatures herein may be treated in accordance with the present invention. It is critical that such streams be substantially free of water before being treated by the presently claimed method. The term, substantially free of water, as used herein, means less than a stoichiometric amount of water based on the total concentration of basic nitrogen compounds in the organic stream.

Non-limiting examples of basic nitrogen compounds which can be separated from organic streams by the practice of the present invention include: heterocyclic nitrogen compounds such as quinoline, tetrahydroquinoline, pyridine, acridine and phenanthridine; aryl amines such as aniline; and aliphatic amines such as methyl amine, ethyl amine, and indoline.

The present invention is not dependent on the method employed for producing the basic nitrogen compoundcontaining stream. For example, any coal liquid containing such nitrogen compounds can be treated regardless of the method used for producing the coal liquid. Nonlimiting examples of processes for producing coal liquids include pyrolysis, solvent refining, direct hydrogenation with or without a catalyst, catalytic and noncatalytic hydrogenation in the presence of a nonhydrogen donor solvent and catalytic and noncatalytic liquefaction by a hydrogen donor solvent method.

In accordance with the invention, the basic nitrogen compound-containing organic stream is first contacted with gaseous sulfur dioxide at atmospheric pressure and at a temperature from about 10° C. to about room temperature (25° C.) for an effective amount of time. The term effective amount of time, as used herein, means at least that amount of time required to ensure substantially complete separation of the basic nitrogen compound in the form of a precipitated complex with sulfur dioxide. Room temperature is preferred although temperatures lower than about 10° C. may be employed if so required owing to the production of a low melting complex. By substantially complete separation it is meant that at least 95 wt.% of the basic nitrogen compounds, based on the total amount of basic nitrogen compound present, which are capable of being removed from a particular organic stream, will be separated out of the stream by way of such complex formation. It will be noted that if higher temperatures are employed, higher pressures would be required to ensure that the sulfur dioxide remains in solution and that the total amount of separation of basic nitrogen compounds from the stream will be decreased. Furthermore, the use of polar solvents or organic streams of a polar nature, will decrease the amount of basic nitrogen compound capable of being removed by the practice of this invention.

In the practice of this invention at least one mol of gaseous sulfur dioxide is employed for each mol of basic nitrogen compound present in the stream. It is preferred to employ at least about 1.5 mols of gaseous sulfur dioxide per mol of basic nitrogen compound present in the stream so as to ensure completion of the reaction. Of course greater amounts of gaseous sulfur dioxide may be employed as desired and the excess recovered and recycled at completion of the reaction for most basic nitrogen compounds in most streams. For some basic nitrogen compounds such as qunioline and tetrahydroquinoline no more than about 2 mols of sulfur dioxide should be used per mole of quinoline and/or tetrahydroquinoline. The determination of the maximum amount of sulfur dioxide suitable for use for any given nitrogen compound and organic stream can be determined by routine experimentation by one having ordinary skill in the art.

The amount and type of basic nitrogen compounds in any given organic stream can be determined by one having ordinary skill in the art by use of conventional analytical methods and will therefore not be discussed herein further detail.

The resulting precipitated complex can be separated from the contacted stream by any appropriate conventional separation technique such as by centrifuging, filtering, or decanting.

An additional amount of gaseous sulfur dioxide is required during the separation step because the precipitated complex is generally not stable in the absence of sulfur dioxide. Such additional amounts are preferably from about 1 to 2 mols of sulfur dioxide per mol of basic nitrogen compound present in the feed stream.

After the precipitated complex is separated from the contacted stream, it is preferred to regenerate both the basic nitrogen compounds and the sulfur dioxide therefrom. This regeneration can be accomplished by either heating the complex and collecting the two components, or by sweeping the complex with an inert gas such as nitrogen. It is preferred to heat the complex and collect the components. In either case, the recovered sulfur dioxide can be recycled to the feed stream.

Depending on the temperature and pressure employed during the contacting step, and the amount of basic nitrogen compounds initially separated, it may be desirable to contact the organic stream from a previous stage a multitude of times to effect substantially complete separation of basic nitrogen compound from the organic stream. For example, after initial contact of the stream with gaseous sulfur dioxide, the treated stream is separated from the resulting precipitated complex and passed on to another stage for contact with additional gaseous sulfur dioxide. This sequence can be repeated as often as practical and desirable.

It is also within the scope of the present invention to employ a non-polar solvent during the contacting step. It must be kept in mind though that if such a solvent is employed the upper reaction temperature may be dependent on the particular solvent employed. Non-limiting examples of such solvents suitable for use herein include petroleum ether (a mixture of pentane and hexane isomers), hexane, pentane, toluene, etc.

The following examples serve to more fully describe the present invention. It is understood that these examples in no way serve to limit the true scope of this invention, but rather, are presented for illustrative purposes.

EXAMPLE 1

Five separate solutions were prepared. Each solution containing (a) four parts by weight of a basic nitrogen component consisting of equal molar mounts of tetrahydroquinoline (THQ) and quinoline (Q); and (b) one part by weight of a selected solvent. Each of these solutions was treated at a temperature of 15° C., for one hour, with a predetermined molar amount of gaseous sulfur dioxide based on the molar concentration of THQ+Q in the solution. The treated solution was then centrifuged for thirty minutes and analyzed by gas chromatography for the percentage of THQ and Q removed from solution. The specific solvents and molar concentrations of sulfur dioxide employed as well as the percentage of THQ and Q removal are set forth for each example in Table I below.

TABLE I

| Solution # | Solvent | N-Base/$SO_2$ Mol Ratio | % Removal of THQ | % Removal of Q |
|---|---|---|---|---|
| 1 | toluene | 1:4 | 0 | 0 |
| 2 | toluene | 1:2 | 56 | 74 |
| 3 | toluene | 1:1.2 | 80 | 83 |
| 4 | hexane | 1:1.2 | 100 | 100 |
| 5 | hexane/ether 1:1 | 1:1.2 | 95 | 97 |

This example illustrates the effectiveness of gaseous sulfur dioxide for removing basic nitrogen compounds such as THQ and Q from various organic streams.

EXAMPLE 2

Ten solutions were prepared containing (a) various solvents, and (b) various basic nitrogen compounds in a variety of concentrations in the solvent. Each of these solutions was treated at 15° C. for one hour with a predetermined molar concentration of gaseous sulfur dioxide per mol of basic nitrogen compound in solution. The treated solution was centrifuged for thirty minutes and analyzed by gas chromotography for the percentage of basic nitrogen compound removed from solution. The specific basic nitrogen compounds, solvents, molar concentration of sulfur dioxide, and percent removal of basic nitrogen compound is shown in Table II below.

TABLE II

| Solution # | N-Base | Solvent | Wt. % of Base in Solvent | $SO_2$ mols | % Removal of N-Base |
|---|---|---|---|---|---|
| 1 | THQ[4] | toluene | 50 | 1.33 | 87 |
| 2 | THIQ[1] | toluene | 50 | 1.33 | 100 |
| 3 | Aniline | toluene | 50 | 1.31 | 100 |
| 4 | Aniline | Toluene | 10 | 1.24 | 87 |
| 5 | THIQ | ether | 10 | 1+[3] | 92 |
| 6 | IQ[2] | ether | 10 | 1+ | 91 |
| 7 | Q | hexane | 10 | 1+ | 86 |
| 8 | Q + THQ 1 to 1 | hexane | 2 | 1+ | Q = 96 THQ = 83 |
| 9 | Q | ether | 10 | 1+ | 4 |
| 10 | THQ | ether | 10 | 1+ | 2 |

1 = tetrahydroisoquinoline
2 = isoquinoline
3 = moles of $SO_2$ for solutions 5 through 10 was slightly more than 1 mol.
4 = Tetrahydroquinoline This example demonstrated the effectiveness of gaseous sulfur dioxide for removing various basic nitrogen streams from organic streams. Also demonstrated is the effect of polar versus nonpolar streams on the removal of such compounds with gaseous sulfur dioxide.

EXAMPLE 3

10.58 g of a coal liquid obtained from a pyrolysis liquefaction process and containing 8.6 wt.% of basic nitrogen compounds, based on the total weight of the coal liquid, was mixed with 2.7 g of toluene at room temperature (about 25° C.). 4.48 g of gaseous sulfur dioxide was bubbled through this mixture. After letting the treated mixture sit at room temperature for 30 minutes it was centrifuged for 30 minutes at 5° C. to separate the resulting solid complex. The liquid phase was then decanted and analyzed for basic nitrogen compound content by conventional analytical techniques. The decanted, treated coal liquid, was found to contain only 3.7 wt.% of basic nitrogen compounds, based on the total weight of the treated coal liquid.

EXAMPLE 4

8.53 g of gaseous sulfur dioxide was bubbled into 200 g of coal derived naphtha. The solution was allowed to sit at room temperature for 30 minutes. The coal derived naphtha was derived from Illinois No. 6 coal and contained 0.13 wt.% of basic nitrogen compounds, based on the total weight of the naphtha. The treated naphtha was then centrifuged for 30 minutes at room temperature to separate any resulting solids from the liquid naphtha phase. The liquid naphtha phase was decanted and examined by conventional analytical techniques for basic nitrogen compounds. It was found that only 0.07 wt.% of basic nitrogen compounds, based on the total weight of the treated naphtha, was present.

EXAMPLE 5

5 grams of gaseous sulfur dioxide was bubbled into 80.3 g of a shale-oil containing 2.5 wt.% basic nitrogen compounds, based on the total weight of the shale-oil.

This solution was allowed to sit at room temperature for 30 minutes after which it was centrifuged for 30 minutes to separate any resulting solids. The treated oil was decanted and was found to contain 1.84 wt.% of basic nitrogen compounds, based on the total weight of the treated shale-oil.

These examples illustrate the effectiveness of sulfur dioxide for removing basic nitrogen compounds from various organic streams wherein such streams are substantially free of water.

What is claimed is:

1. A method for separating basic nitrogen compounds from an organic feedstream selected from the group consisting of coal liquids, oil-shale liquids, petroleum oils, and coal bottoms which are soluble in common organic solvents at temperatures from about 10° C. to about 25° C., which stream is substantially free of water, the method comprising:

(a) contacting said stream at a temperature from about 10° C. to about 25° C. with gaseous sulfur dioxide thereby effecting a precipitate containing basic nitrogen compounds; and (b) separating the precipitate from the contact stream.

2. The method of claim 1 wherein the organic stream is selected from the group consisting of coal liquids, oil-shale liquids, and petroleum oils.

3. The method of claim 1 or 3 wherein at least one mol of gaseous sulfur dioxide is employed for each mol of basic nitrogen compound present in the stream.

4. The method of claim 2 wherein at least 1.5 mols of gaseous sulfur dioxide are employed for each mol of basic nitrogen compound present in the stream.

5. The method of claim 1 or 2 wherein the precipitate is separated from the contacted stream by a method selected from the group consisting of centrifuging, filtering and decanting.

6. The method of claim 1 or 2 wherein the separated precipitate is heated to its decomposition temperature, its components collected and the sulfur dioxide composition recycled to the feed stream.

* * * * *